United States Patent [19]

Palermo, Jr.

[11] Patent Number: 4,494,811

[45] Date of Patent: Jan. 22, 1985

[54] HIGH VOLTAGE CONNECTOR ASSEMBLY WITH INTERNAL OIL EXPANSION CHAMBER

[75] Inventor: Anthony Palermo, Jr., South Euclid, Ohio

[73] Assignee: Picker Corporation, Highland Heights, Ohio

[21] Appl. No.: 431,702

[22] Filed: Sep. 30, 1982

Related U.S. Application Data

[63] Continuation of Ser. No. 215,003, Dec. 10, 1980, abandoned.

[51] Int. Cl.[3] ..... H01R 13/52

[52] U.S. Cl. ..... 339/94 R; 339/117 R

[58] Field of Search ..... 339/94, 117, 118

[56] References Cited

U.S. PATENT DOCUMENTS

| | | | |
|---|---|---|---|
| 2,857,557 | 10/1958 | Imhoff | 339/117 R |
| 3,115,380 | 12/1963 | Kuehl et al. | 339/117 P |
| 3,374,331 | 3/1968 | Brockhaus et al. | 339/117 R |
| 3,643,207 | 2/1972 | Cairns | 339/117 R |
| 3,968,373 | 7/1976 | Reifenschweiler | 250/419 |
| 4,054,351 | 10/1977 | Gallay et al. | 339/117 R |
| 4,335,928 | 6/1982 | Barrett et al. | 339/94 C |

*Primary Examiner*—Neil Abrams

*Attorney, Agent, or Firm*—Watts, Hoffmann, Fisher & Heinke Co.

[57] ABSTRACT

An oil filled high voltage connector assembly, such as the type used to connect high voltage X-ray apparatus cables, which includes an internally located oil expansion chamber. A female connector defines a cylindrical container closed at one end and has an outward extending flange. An annulus having a hollowed out cavity on one surface is covered with an elastomeric material in contact with the flange. A liquid dielectric between the female connector and a male connector presses against the elastomeric material and can push the elastomeric material into the cavity when it expands.

5 Claims, 1 Drawing Figure

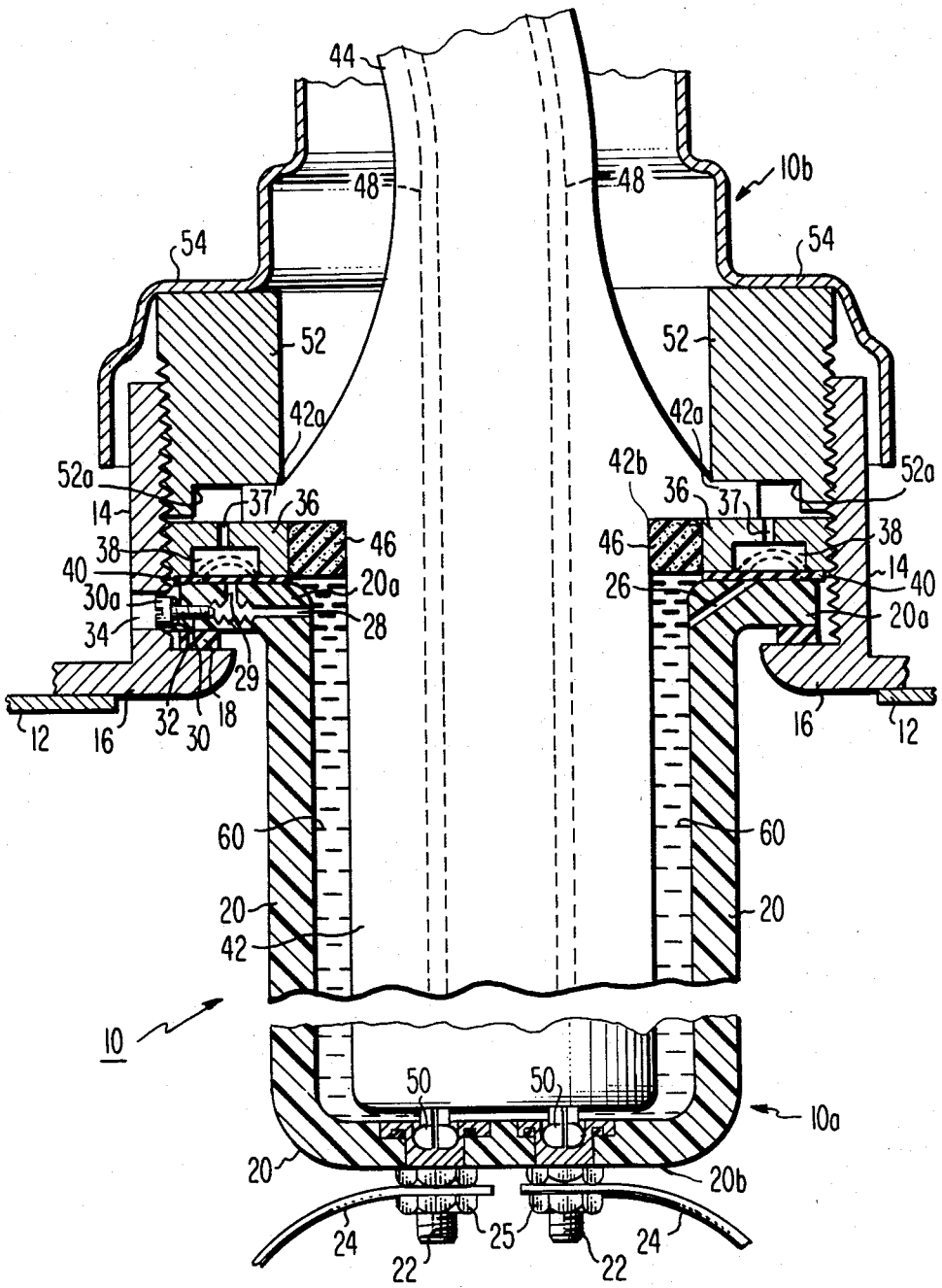
44
48
48
10b
54
54
52
52
42a
42a
52a
52a
14
37
36
42b
36
37
38
46
46
38
40
20a
26
14
40
30a
28
20a
34
29
12
16
32
30
18
16
12
60
60
20
20
42
10
50
50
10a
20
20b
24
25
24
22
22

HIGH VOLTAGE CONNECTOR ASSEMBLY WITH INTERNAL OIL EXPANSION CHAMBER

This is a continuation of application Ser. No. 215,003 filed Dec. 10, 1980, now abandoned.

This invention relates to a high voltage connector assembly, and particularly to such a connector assembly which is filled with an expandable liquid dielectric.

High voltage connector assemblies are used in a number of applications, including X-ray apparatus where they are used in conjunction with cabling to electrically connect an X-ray tube to a generator (power supply). Such connector assemblies are known to be subject to electrical arcing. To prevent arcing, it is known to put grease between the cable termination and receptacle ports comprising the connector assembly.

The purpose of the grease is to displace air from the space between the cable termination and the receptacle. Air generally is not a good insulator and ionizes easily at the high voltages (75 kilovolts) used on X-ray equipment. The ionized air will cause a disruptive arc discharge along the cable/receptacle mating surface. The use of insulating grease prevents this from happening. The greases generally used have been either petroleum jelly or silicone compounds.

Greases are used as a compromise measure. They exhibit the property of "hardening" or drying out after extended use. In many cases, the greases flow out of the receptacle during heat build-up. Both of the above factors cause voids and air pockets to form. An arc discharge could then occur. In many cases, the compound itself breaks down and the high voltage track is through the compound without damaging the cable or the receptacle.

The primary fault of the grease technique is not the grease itself, but in its application to the termination. It is almost an impossible task to know when the grease fills its air space because the serviceman cannot look into the blind termination. The most ideal insulating compound to use in this application is regular transformer oil. It is fluid, wets all surfaces, has excellent life, and has good dielectric strength.

On many cable connected installations where the connector assembly is in a vertical position and never tipped or rotated, transformer oil is used to displace the air. The vertical connector assembly "holds" the oil. Oil expansion due to heat build-up in this case is of no consequence.

Oil has not been used in tippable connector assemblies for two reasons: (1) No method was known of how to fill the air space with oil after the cable was installed without making the connector assembly bulky and unwieldly. (2) No method was known of how to provide oil expansion without making the connector assembly bulky and unwieldly.

U.S. Pat. No. 4,054,351 issued Oct. 18, 1977 to M. Gallay et al. describes the use of a liquid dielectric (oil) to fill the spaces in a high voltage connector assembly to prevent arcing. Since the oil fills all available space a provision must be made for oil expansion. In Gallay, an oil expansion chamber 29 externally mounted to the connector assembly provides for oil expansion. Such an expansion chamber is subject to damage, such as being sheared off.

In accordance with a preferred embodiment of the instant invention, a high voltage cable connector assembly comprises first and second connectors sized to permit interconnection while leaving some space therebetween and means for securing the two connectors together and for providing a liquid-tight seal therebetween. One of the connectors includes an expansion chamber internal thereto which is interconnected with the space. A dielectric expandable liquid fills the spaces and upon expansion flows into the internal expansion chamber.

In the drawing:

The sole FIGURE is an axial cross-section of a high voltage connector assembly in accordance with a preferred embodiment of the invention.

Referring now to the FIGURE, a female connector **10*a* of a high voltage connector assembly 10 in accordance with the invention is secured to a suitable metallic housing, a portion thereof being indicated by legend 12. In particular, connector 10*a* includes, by way of example, a cylindrical internally threaded metallic flanged collar 14 having an internal lip 16, a flat circular sealing gasket 18 of, for example, neoprene which rests on lip 16, a receptacle 20 and a retaining ring 36**.

Receptacle 20 is generally cylindrically shaped with a closed end wall **20*b* and with an outward extending ring-like flange 20*a* at the open end thereof which rests on gasket 18. Receptacle 20 is typically a part of a connector which is of the type specified by the U.S. government for high voltage connectors used on X-ray equipment and referred to as a "Federal Standard 75 K.V. Connector." Receptacle 20 is made of liquid impervious electrically insulating material such as bakelite with a plurality of conductive female contacts 22 which may be molded into and extend through end wall 20*b* thereof, two such contacts being shown. Each of female contacts 22 includes a flange recessed inside wall 20*b* and includes a threaded portion around which and extending therefrom is an electric conductor 24 which passes high voltage to or from connector 10*a*. Conductor 24 is typically held on contact 22 by threaded nuts 25. Receptacle 20**, while otherwise of conventional design, is modified in one of two respects.

A small aperture 26 of, for example, approximately 1.6 millimeters in diameter is drilled at an angle through flange **20*a* to inner cylindrical surface of receptacle 20** to permit passage of liquid dielectric material as will be described hereinafter.

As an alternative to aperture 26, two small apertures 28, only one being shown, extend parallel to and through flange **20*a*. The apertures may be positioned approximately 20 millimeters apart about the axis of the receptacle 20. An additional aperture 29 extends from one aperture 28 to the upper surface of flange 20*a* for reasons to be described hereinafter. Each of the apertures 28 is partially threaded as illustrated in the FIGURE to accept a screw plug such as screw 30 with a sealing O-ring 32. A matching clearance aperture 34 is created in collar 14 to permit screw 30 to pass therethrough. When the screw is positioned fully into aperture 28 the head 30*a* of the screw extends into aperture 34. The apertures 28** permit a liquid dielectric to be added to the connector assembly through one aperture while air escapes through the other as will be described more fully hereinafter.

Externally threaded retainer ring 36, sized to engage the threads on collar 14, is positioned atop flange **20*a*. It has a plurality of apertures 37 (two being shown) to permit it to be tightened by a spanner wrench (not shown), and when fully tightened forces flange 20*a* against gasket 18. Ring 36 in accordance with the invention is non-standard in that it has a hollow chamber 38 on the side facing flange 20***a* as illustrated in the FIGURE. The flange 20*a* side of ring 36 is covered with an expandable gasket 40 of elastomeric material bonded to the ring. For the instant application, a gasket 40 is made of Buna N material of 0.25–0.40 millimeters in thickness and has an elastic coefficient of durometer 60. In summary, female connector 10*a* comprises flanged collar 14, gasket 18, receptacle 20, two seal-type screws 30 and retainer ring 36 with gasket 40.

The male connector 10*b* includes a cylindrical molded electrically insulating member 42 sized to fit inside receptacle 20 and bonded to a high voltage multiconductor cable 44, only a small portion of which is shown. It will be noted that for drawing clarity member 42 is not shown in crosssection. A similar male connector 10*b* (not shown) is attached to the other end of cable 44 (not shown). Cylindrical member 42 has a flanged portion 42*a*, which, when in position, rests atop ring 36. A sealing ring gasket 46 surrounds shoulder portion 42*b* of member 42. Wires 48 shown dotted extend from cable 44 through member 42 to electrical pin-type contacts 50 which may be molded into member 42. When connector 10*b* is fully inserted in connector 10*a* pin contacts 50 engage female contacts 22 thereby permitting high voltage electricity to be passed between cable 44 and wires 24.

An externally threaded ring 52 has a shoulder 52*a* which coöperates with flange 42*a* to secure connector 10*b* to connector 10*a*. A ferrule 54 is mechanically secured to ring 52 such that, as the ferrule is turned, the threads on ring 52 engage the threads on collar 14 enabling connector 10*b* to be secured to connector 10*a* or enabling 10*b* to be removed from connector 10*a*. With the flange 42*a* touching ring 36 gasket 46 touches and is compressed by ring 36 to make a liquid-tight seal.

The operation of the connector assembly is as follows. If the female connector 10*a* can be positioned upright as illustrated in the FIGURE, a small measured amount of liquid dielectric material, such as transformer oil 60 is put into receptacle 20 after plugging apertures 28 (one shown) with screws 30. Optionally, holes 28 and 29 may be omitted if connector 10*a* can always be placed upright for oil filling. Then member 42 is inserted in receptacle 20 and pushed all the way in such that flange 42*a* contacts ring 36. Then ferrule 54 is turned in such a direction as to cause ring 52 to maintain flange 42*a* against ring 36. With the proper amount of oil added the space between member 42 and receptacle 20 is just filled with oil 60 up to gasket 46 which prevents oil leaking out of the connector assembly. If the connector 10*a* cannot be positioned vertically for oil filling, connector 10*b* is secured to connector 10*a* as described above without first adding oil, then the connector assembly 10 is rotated until apertures 28 (only one shown) are upright. Then oil is dispensed into one hole while displaced air escapes through the other hole. When the oil filling operation is complete, screws 30 are positioned in apertures 28 to act as plugs and again the oil fills all the space between member 42 and receptacle 20 up to gasket 46.

Oil expands as a function of temperature. Since connector assembly 10 is "full" of oil at all times the expanded oil, due to temperature, traverses bore 26 or apertures 28 and 29 (whichever is/are present) causing gasket 40 to bow upward into cavity 38 as illustrated in phantom. Apertures 37 act as venting holes to vent the topside of gasket 40 to the atmosphere which prevents a build-up of back pressure. Gasket 40 therefore acts as an expanding diaphragm. In the absence of the chamber 38 in ring 36 the oil would push past gasket 46, between flange 42*a* and ring 36, between the threads on members 14 and 52 and out of the connector assembly, an intolerable situation.

It will be recognized that expansion chamber 38 need not take the exact form illustrated in the FIGURE. For example, the chamber 38 may face inward toward member 42 in which case apertures 26 or 29 are not needed. Alternatively, the hollowed out portion may be in flange 20*a* which could be most advantageously accomplished if apertures 28 are not needed.

What is claimed is:

1. A high voltage connector assembly comprising a female connector and a male connector, said female connector comprising:

a generally cylindrical support member having an inwardly extending lip;

a generally cylindrical container closed at one end and having an outwardly extending flange at the opposite end, at least one part of said container being located within said support member, at least part of said lip and flange being coextensive;

an annulus positioned in said member for urging said flange and lip toward one another, said annulus having a hollowed out annular cavity on one planar surface thereof, said one planar surface and cavity being covered by an elastomeric material, said elastomeric material being held in place between said planar surface and said flange;

said male connector comprising:

a generally cylindrical member of diameter smaller than and adopted for insertion in said female generally cylindrical container such that there is a gap between said male and female cylindrical members which extends to said elastomeric material, means to engage said support member for creating a liquid-tight seal between said male and female connectors; and a liquid dielectric in said gap which when expanded depresses said elastomeric material into said cavity.

2. The combination as set forth in claim 1 further including at least one filling aperture in said flange extending between the outside edge of said flange and said gap for permitting said filling of said gap.

3. The combination of claim 1 wherein said support member comprises an internally threaded collar.

4. The combination set forth in claim 3 wherein said annulus includes screw thread on its outer cylindrical surface for interacting with said support member to secure said container to said support member.

5. The combination as set forth in claim 1 wherein said liquid dielectric material is oil.

* * * * *